US006578644B2

(12) United States Patent
Frenzel et al.

(10) Patent No.: US 6,578,644 B2
(45) Date of Patent: Jun. 17, 2003

(54) PERCUSSION ROTARY HAND-HELD POWER TOOL WITH A ROTATABLE GUIDE TUBE

(75) Inventors: Jens Frenzel, Landsberg (DE); Hans-Werner Bongers-Ambrosius, Munich (DE); Peter Gerold, Weilheim (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/017,938

(22) Filed: Dec. 7, 2001

(65) Prior Publication Data

US 2002/0070036 A1 Jun. 13, 2002

(30) Foreign Application Priority Data

Dec. 12, 2000 (DE) ..... 100 61 810

(51) Int. Cl.[7] ..... B25D 17/08
(52) U.S. Cl. ..... 173/128; 173/129; 173/162.1
(58) Field of Search ..... 173/71, 110, 128, 173/129, 131, 132, 133, 162.1, 213; 175/296

(56) References Cited

U.S. PATENT DOCUMENTS 3,712,387 A * 1/1973 Vincent et al. ..... 173/73
4,131,165 A * 12/1978 Wanner et al. ..... 173/48
4,434,859 A * 3/1984 Rumpp et al. ..... 173/48
4,681,172 A * 7/1987 Mikiya et al. ..... 173/210
5,873,579 A * 2/1999 Prokop et al. ..... 279/19

FOREIGN PATENT DOCUMENTS

| | | |
|---|---|---|
| DE | 9724531 | 12/1998 |
| EP | 0735230 | 10/1996 |
| GB | 2053769 A * | 2/1981 |

* cited by examiner

*Primary Examiner*—Scott A. Smith
*Assistant Examiner*—Nathaniel Chukwurah
(74) *Attorney, Agent, or Firm*—Sidley Austin Brown & Wood, LLP

(57) ABSTRACT

A percussion rotary hand-held power tool including a percussion piston (3), an anvil (5), a chuck (4) for receiving a working tool, an axially displaceable and rotatable guide tube (6) located in the housing (2) and extending in a telescopic-like manner over the chuck (4) and the anvil (5) from a chuck region up to a region of the percussion piston (3), and a sealing element (8) located between the guide tube (6) and the housing (2) and having at least one axial seal (9) for performing only axial movement and at least one rotary shaft seal (10) for performing only rotary movement.

7 Claims, 2 Drawing Sheets

PERCUSSION ROTARY HAND-HELD POWER TOOL WITH A ROTATABLE GUIDE TUBE

BACKGROUND OF THE INVENTION

1. Field of the Invention

The present invention relates to a percussion rotary hand-held power tool including an axially displaceable anvil, an axially displaceable percussion piston, and a rotatable guide tube which serves as a working tool spindle and provides for axial guidance of the percussion piston.

2. Description of the Prior Art

In the hand-held power tools of the type described above, axial blows from the percussion piston are transmitted to a working tool by an axially displaceable anvil which has, however, a small displacement path. As a result of an oscillating movement of the anvil, dust can penetrate into the percussion mechanism and/or oil can be released from the percussion mechanism into the environment. However, the penetration of dust into the percussion mechanism and/or release of oil therefrom can be prevented with appropriate seals. With an insufficient reaction force applied by the working tool, the highly accelerated anvil can reach into an axially adjacent, working tool-side, idle stroke region. This can be used for cutting off the idle stroke.

Axial displacement and high speed of the anvil in the direction of the working tool, which take place during the idle stroke, lead to a noticeably reduced scrapping capability of the sealing elements and to penetration of dust into the percussion mechanism during the slow movement of the anvil back to its operating point. From the percussion mechanism, the dust can penetrate further into the power tool drive. The dust penetration into the power tool drive substantially reduces the service life of the drive components.

German Publication DE-197 24 53 1A1 discloses a power tool in which the guide tube, which serves as a working tool spindle and is movable axially for cutting off the idle stroke, extends in a telescopic-like manner over the anvil from the chuck region up to the percussion piston region. In case of an idle stroke, the axially displaceable guide tube, as a result of its axial displacement, reduces the relative displacement of the anvil and, thereby, penetration of dust into the percussion mechanism. However, an axial displacement of the rotatable guide tube complicates sealing of the space between the radially outer side of the guide tube and the housing. Insufficient sealing of this space leads to penetration of dust into the percussion mechanism and further into the drive.

European Publication EP-0759341 discloses a power tool with an axially stationary guide tube which serves as a rotatable working tool spindle and which telescopically extends over the anvil and extends from the chuck region to the region of the percussion piston, and with a rotary shaft seal provided between the outer surface of the guide tube and the power tool housing. The idle stroke cut-off is effected by a separate switch sleeve which is located in the guide tube and is displaced axially by the anvil.

British Publication No. 2,053,769 discloses a percussion mechanism with rotatable and axially displaceable components and with separate axial sealing and rotary shaft sealing.

European Publication EP-0 735 230 discloses a percussion rotary hand-held power tool with a rotary swivel provided with a sealing element including separate from each other, axial seals and radial seals which are separated by a sleeve-shaped housing element having one axial degree of freedom and one circumferential degree of freedom.

An object of the present invention is to provide a percussion rotary hand-held power tool with a rotatable and an axially displaceable guide tube that is adequately sealed against dust penetration even during the idle stroke.

SUMMARY OF THE INVENTION

This and other objects of the present invention, which will become apparent hereinafter, are achieved by providing a percussion rotary hand-held power tool including a housing, a percussion piston located in the housing, an anvil located in the housing, a chuck for receiving a working tool, an axially displaceable and rotatable guide tube serving as a working tool spindle, located in the housing and extending in a telescopic-like manner over the chuck and the anvil from a chuck region up to a region of the percussion piston, and a sealing element located between the guide tube and the housing and having at least one axial seal for performing only axial movement and at least one rotary shaft seal for performing only rotary movement.

According to the present invention, efficient, special seals such as rotary shaft rings for a pure rotational movement and scrapper rings for a pure axial movement substantially prevent dust penetration into the percussion mechanism and further into the power tool drive despite the complex percussion-rotary movement of the guide tube.

Advantageously, there is provided, in the power tool housing, an axially displaceable housing element arranged between the guide tube and the housing coaxially with the guide tube. The housing element is supported in the housing without a possibility of rotation relative thereto. The housing element insures a simple separation of the rotational and percussion movements.

Advantageously, the housing element is formed as a sleeve, which permits to use standard annular seals.

Advantageously, the axial seal is formed as a static seal, e.g., as a bellows which permits to achieve a space-saving and reliable sealing for the existing limited number of limited axial displacements.

Advantageously, the housing element is at least partially radially offset which permits to provide an axial stop in the housing for the guide tube.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENT

Figure 1:
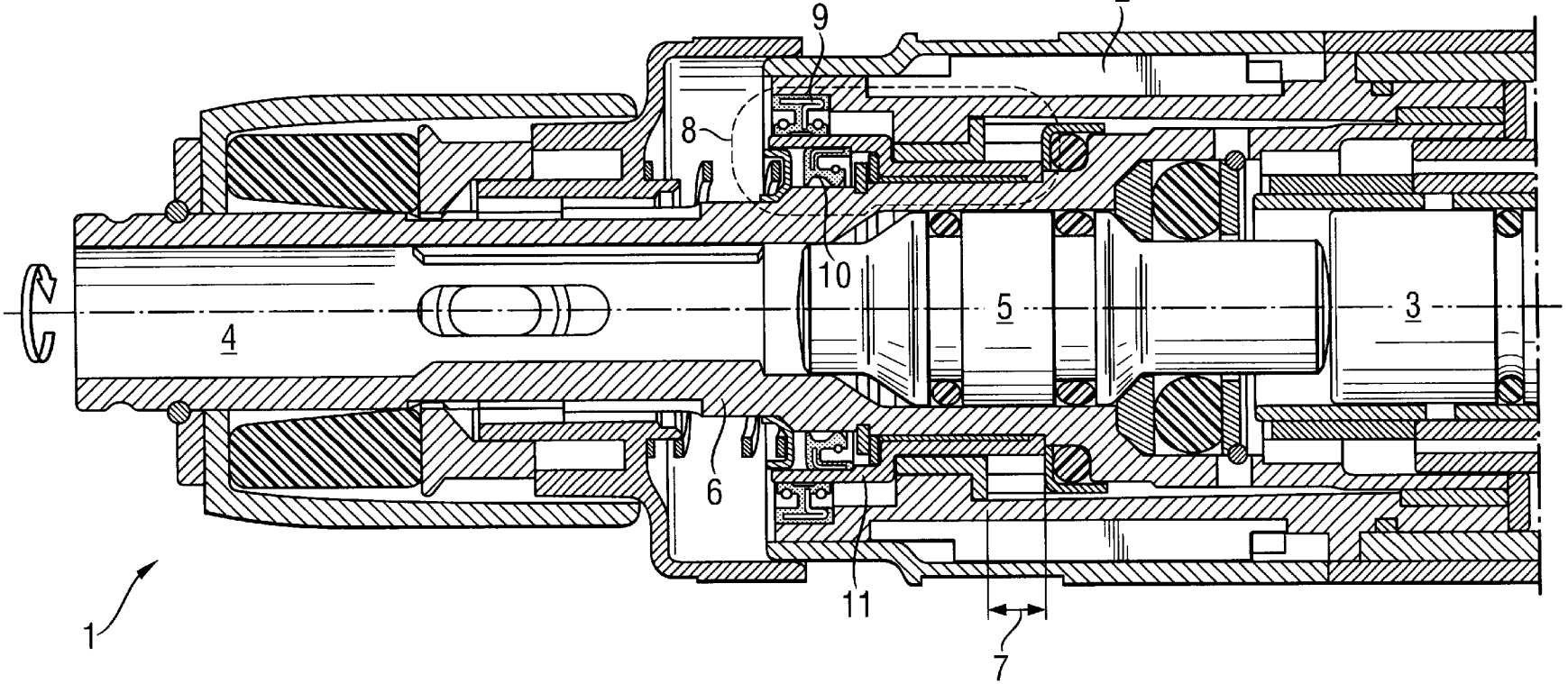
FIG. 1 a cross-sectional view of a percussion hand-held power tool with a rotatable guide tube according to the present invention.

A percussion hand-held rotary power tool 1 according to the present invention, which is shown in FIG. 1, includes a rotatable and axially displaceable guide tube 6 which is supported in a housing 2 and serves as a working tool spindle. The guide tube 6 provides for axial guidance of the percussion piston 3 and extends in a telescopic-like manner over a chuck 4 and an anvil 5 from the chuck region up to the region of the percussion piston 3. The guide tube 6 is displaced during an idle percussion stroke cut-off by a distance 7. A sealing element 8, which is arranged between an outer surface of the guide tube 6 and the housing 2 includes an axial seal 9, which is formed as an annular scrapper ring and which is displaceable only axially, and a rotary shaft seal 10 which is formed as a shaft seal ring and is able only to rotate. Between the guide tube 6 and the housing 2, there is provided an axially displaceable housing element 11 which is arranged outside of the guide tube 6 coaxially therewith. The housing element 11 is formed as a sleeve. The rotary shaft seal 10 is arranged between the guide tube 6 and the housing element 11. The axial seal 9 is arranged between the housing 2 and the housing element 11.

Figure 2:
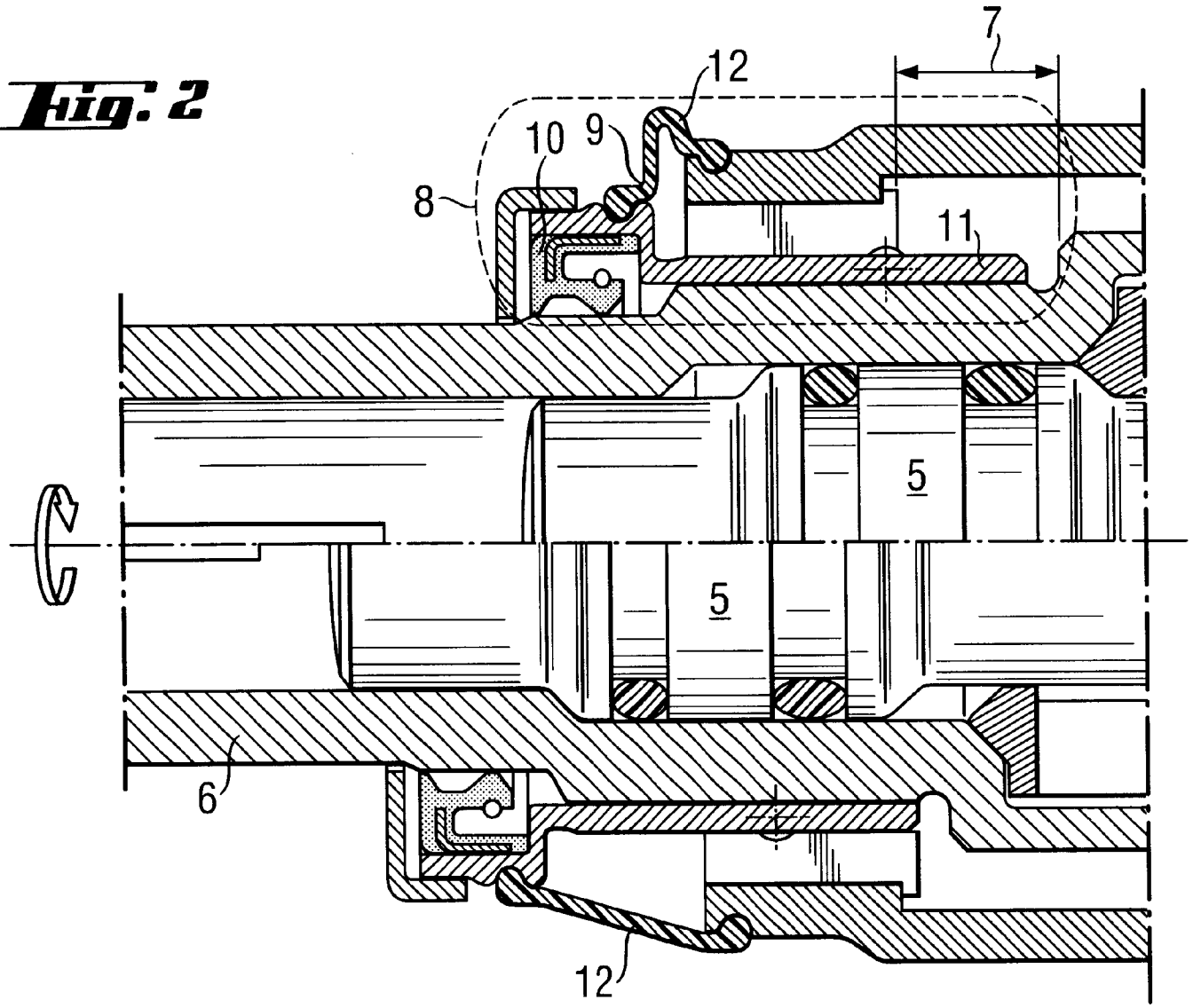
FIG. 2 a cross-sectional view of a static sealing used in the power tool according to the present invention.

FIG. 2 shows another embodiment of the sealing element 8. In this embodiment, likewise, the rotary shaft seal is arranged between the housing element 11 and the guide tube 6, and the axial seal 9 is arranged between the housing element 11 and the housing 2. However, in this embodiment, the axial seal 9 is formed as a bellows 12 having an axial length corresponding to the idle stroke displacement 7.

Though the present invention was shown and described with references to the preferred embodiments, such are merely illustrative of the present invention and are not to be construed as a limitation thereof, and various modifications of the present invention will be apparent to those skilled in the art. It is, therefore, not intended that the present invention be limited to the disclosed embodiments or details thereof, and the present invention includes all variations and/or alternative embodiments within the spirit and scope of the present invention as defined by the appended claims.

What is claimed is:

1. A percussion rotary hand-held power tool, comprising a housing (2); a percussion piston (3) located in the housing (2); an anvil (5) located in the housing (2); a chuck (4) for receiving a working tool; an axially displaceable and rotatable guide tube (6) serving as a working tool spindle, located in the housing (2) and extending in a telescopic-like manner over the chuck (4) and the anvil (5) from a chuck region up to a region of the percussion piston (3); and a sealing element (8) located between the guide tube (6) and the housing (2) and having at least one axial seal (9) for performing only axial movement and at least one rotary shaft seal (10) for performing only rotary movement.

2. A percussion rotary hand-held power tool according to claim 1, further comprising an axially displaceable housing element (11) arranged between the guide tube (6) and the housing (2) coaxially with the guide tube (6), the housing element (11) being supported in the housing (2) without a possibility of rotation relative thereto.

3. A percussion rotary hand-held power tool according to claim 2, wherein the rotary shaft seal (10) is arranged between the guide tube (6) and the housing element (11), and the axial seal (9) is arranged between the housing element (11) and the housing (2).

4. A percussion rotary hand-held power tool according to claim 2, wherein the housing element (11) is formed as a sleeve.

5. A percussion rotary hand-held power tool according to claim 2, wherein the housing element (11) is radially offset relative to the housing (2).

6. A percussion rotary hand-held power tool according to claim 1, wherein the axial seal (9) is formed as a static seal with a bellows (12).

7. A percussion rotary hand-held power tool according to claim 6, wherein the bellows (12) has an axial length corresponding to an idle stroke cut-off displacement (7) of the guide tube (6).

* * * * *